US010680311B2

(12) United States Patent
Sun et al.

(10) Patent No.: US 10,680,311 B2
(45) Date of Patent: Jun. 9, 2020

(54) COMMUNICATIONS TERMINAL

(71) Applicant: Huawei Technologies Co., Ltd., Shenzhen (CN)

(72) Inventors: Shuhui Sun, Shenzhen (CN); Zhenghao Li, Shenzhen (CN); Huiliang Xu, Shenzhen (CN); Yi Fan, Shenzhen (CN); Bo Meng, Shenzhen (CN); Dongxing Tu, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 575 days.

(21) Appl. No.: 15/507,026

(22) PCT Filed: Aug. 30, 2014

(86) PCT No.: PCT/CN2014/085631
§ 371 (c)(1),
(2) Date: Feb. 27, 2017

(87) PCT Pub. No.: WO2016/029478
PCT Pub. Date: Mar. 3, 2016

(65) Prior Publication Data

US 2017/0373372 A1 Dec. 28, 2017

(51) Int. Cl.
*H01Q 1/22* (2006.01)
*H01Q 1/52* (2006.01)
(Continued)

(52) U.S. Cl.
CPC ..... *H01Q 1/22* (2013.01); *H01Q 1/243* (2013.01); *H01Q 1/44* (2013.01); *H01Q 1/521* (2013.01);
(Continued)

(58) Field of Classification Search
CPC ..... H01Q 1/22; H01Q 1/521; H01Q 9/42; H01Q 9/0421; H01Q 1/243; H01Q 5/357;
(Continued)

(56) References Cited

U.S. PATENT DOCUMENTS

2011/0027704 A1 2/2011 Cramer et al.
2012/0218723 A1* 8/2012 Kwak ..... H01Q 1/243 361/748
(Continued)

FOREIGN PATENT DOCUMENTS

CN 202282452 U 6/2012
CN 102983405 A 3/2013
(Continued)

OTHER PUBLICATIONS

Machine Translation and Abstract of Japanese Publication No. JP2012-249281, Dec. 13, 2012, 33 pages.
(Continued)

*Primary Examiner* — Hai V Tran
*Assistant Examiner* — Michael M Bouizza
(74) *Attorney, Agent, or Firm* — Conley Rose, P.C.

(57) ABSTRACT

A communications terminal includes a mainboard, a conductor bezel, a first conductor part, and a second conductor part, where a first location on the conductor bezel is electrically connected to a ground terminal on the mainboard, a second location on the conductor bezel is electrically connected to a ground terminal on the mainboard, the second conductor part is electrically connected to a fourth location on the conductor bezel, and a radio frequency port on the mainboard is electrically connected to a third location on the conductor bezel using the first conductor part; and the fourth location and the third location on the conductor bezel are between the first location and the second location. The
(Continued)

communications terminal is conducive to reducing antenna assembly complexity and reducing manufacturing costs.

21 Claims, 20 Drawing Sheets

(51) Int. Cl.

| | |
|---|---|
| ***H01Q 1/42*** | (2006.01) |
| ***H01Q 1/24*** | (2006.01) |
| ***H01Q 1/44*** | (2006.01) |
| ***H01Q 5/357*** | (2015.01) |
| ***H01Q 21/30*** | (2006.01) |
| ***H01Q 9/42*** | (2006.01) |
| ***H01Q 9/04*** | (2006.01) |
| ***H01Q 13/10*** | (2006.01) |

(52) U.S. Cl.
CPC ..... *H01Q 5/357* (2015.01); *H01Q 9/0421* (2013.01); *H01Q 9/42* (2013.01); *H01Q 13/10* (2013.01); *H01Q 21/30* (2013.01); *H01Q 1/42* (2013.01)

(58) Field of Classification Search
CPC ..... H01Q 21/30; H01Q 13/10; H01Q 1/44; H01Q 1/42
See application file for complete search history.

(56) References Cited

U.S. PATENT DOCUMENTS

| | | | | |
|---|---|---|---|---|
| 2012/0299785 | A1 | 11/2012 | Bevelacqua | |
| 2013/0057437 | A1 | 3/2013 | Chiu et al. | |
| 2014/0184449 | A1* | 7/2014 | Dong | H01Q 13/106 343/702 |
| 2014/0292590 | A1 | 10/2014 | Yoo et al. | |

FOREIGN PATENT DOCUMENTS

| | | | |
|---|---|---|---|
| CN | 103050773 | A | 4/2013 |
| CN | 103296385 | A | 9/2013 |
| CN | 103326124 | A | 9/2013 |
| CN | 103346383 | A | 10/2013 |
| CN | 103606736 | A | 2/2014 |
| CN | 203589193 | U | 5/2014 |
| CN | 104079313 | A | 10/2014 |
| CN | 104466392 | A | 3/2015 |
| EP | 2784873 | A1 | 10/2014 |
| JP | 2012249281 | A | 12/2012 |
| JP | 2014030048 | A | 2/2014 |
| TW | 201251202 | A | 12/2012 |
| WO | 2008157725 | A1 | 12/2008 |

OTHER PUBLICATIONS

Foreign Communication From a Counterpart Application, Japanese Application No. 2017-511751, Japanese Office Action dated Mar. 27, 2018, 4 pages.
Foreign Communication From a Counterpart Application, Japanese Application No. 2017-511751, English Translation of Japanese Office Action dated Mar. 27, 2018, 5 pages.
Machine Translation and Abstract of Chinese Publication No. CN103050773, Apr. 17, 2013, 5 pages.
Machine Translation and Abstract of Chinese Publication No. CN104079313, Oct. 1, 2014, 9 pages.
Machine Translation and Abstract of Chinese Publication No. CN103296385, Sep. 11, 2013, 9 pages.
Machine Translation and Abstract of Chinese Publication No. CN103326124, Part 1, Sep. 25, 2013, 11 pages.
Machine Translation and Abstract of Chinese Publication No. CN103326124, Part 2, Sep. 25, 2013, 4 pages.
Machine Translation and Abstract of Chinese Publication No. CN103346383, Oct. 9, 2013, 9 pages.
Machine Translation and Abstract of Chinese Publication No. CN103606736, Part 1, Feb. 26, 2014, 10 pages.
Machine Translation and Abstract of Chinese Publication No. CN103606736, Part 2, Feb. 25, 2014, 10 pages.
Machine Translation and Abstract of Chinese Publication No. CN104466392, Part 1, Mar. 25, 2015, 7 pages.
Machine Translation and Abstract of Chinese Publication No. CN104466392, Part 2, Mar. 25, 2015, 3 pages.
Machine Translation and Abstract of Chinese Publication No. CN202282452, Jun. 20, 2012, 5 pages.
Machine Translation and Abstract of Chinese Publication No. CN203589193, May 7, 2014, 5 pages.
Foreign Communication From a Counterpart Application, European Application No. 14900523.3, Extended European Search Report dated Jun. 29, 2017, 12 pages.
Foreign Communication From a Counterpart Application, Chinese Application No. 201480014980.9, Chinese Office Action dated May 26, 2017, 8 pages.
Foreign Communication From a Counterpart Application, PCT Application No. PCT/CN2014/085631, English Translation of International Search Report dated Jun. 10, 2015, 2 pages.
Foreign Communication From a Counterpart Application, PCT Application No. PCT/CN2014/085631, English Translation of Written Opinion dated Jun. 10, 2015, 7 pages.

* cited by examiner

COMMUNICATIONS TERMINAL

CROSS-REFERENCE TO RELATED APPLICATION

This application is a national stage of International Application No. PCT/CN2014/085631, filed on Aug. 30, 2014, which is hereby incorporated by reference in its entirety.

TECHNICAL FIELD

The present disclosure relates to the field of communications technologies, and in particular, to a communications terminal.

BACKGROUND

Currently, many communications terminals, such as a mobile phone, a tablet computer, and a wireless router, use a metal housing solution, for example, use a conductor bezel or a metal back cover. Antenna design performed on a basis of the outline metal housing solution mostly uses a slitting or slotting solution.

Currently, a single-antenna, such as a wireless local area network antenna, design solution is mostly a monopole, inverted F antenna, or metal ring antenna solution. In an existing antenna solution, each conductor bezel segment supports only one band. That is, if multiple bands need to be supported, multiple antennas need to be designed to support the multiple bands respectively, which leads to relatively high complexity of assembling the antennas and increases manufacturing costs to some extent.

SUMMARY

Embodiments of the present disclosure provide a communications terminal, to reduce antenna assembly complexity and manufacturing costs of the communications terminal.

A first aspect of the present disclosure provides a communications terminal, including a mainboard, a conductor bezel, a first conductor part, and a second conductor part, where a first location on the conductor bezel is electrically connected to a ground terminal on the mainboard, a second location on the conductor bezel is electrically connected to a ground terminal on the mainboard, the second conductor part is electrically connected to a fourth location on the conductor bezel, and a radio frequency port on the mainboard is electrically connected to a third location on the conductor bezel using the first conductor part; and the fourth location and the third location on the conductor bezel are between the first location and the second location.

With reference to the first aspect, in a first possible implementation manner of the first aspect, the first conductor part includes a first conductor and a second conductor, where the second conductor is electrically connected to the radio frequency port on the mainboard of the communications terminal, the first conductor is electrically connected to the third location on the conductor bezel, and the first conductor is further electrically connected to the second conductor.

With reference to the first possible implementation manner of the first aspect, in a second possible implementation manner of the first aspect, the first conductor and the second conductor are located on a same straight line, or an inclined angle formed between the first conductor and the second conductor is an acute angle, an obtuse angle, or a right angle.

With reference to the first possible implementation manner of the first aspect or the second possible implementation manner of the first aspect, in a third possible implementation manner of the first aspect, a location, electrically connected to the second conductor, on the first conductor is an end of the first conductor, or a location, electrically connected to the second conductor, on the first conductor is a location on the first conductor except an end of the first conductor.

With reference to the first possible implementation manner of the first aspect, the second possible implementation manner of the first aspect, or the third possible implementation manner of the first aspect, in a fourth possible implementation manner of the first aspect, a location, electrically connected to the first conductor, on the second conductor is an end of the second conductor, or a location, electrically connected to the first conductor, on the second conductor is a location on the second conductor except an end of the second conductor.

With reference to the first aspect, the first possible implementation manner of the first aspect, the second possible implementation manner of the first aspect, the third possible implementation manner of the first aspect, or the fourth possible implementation manner of the first aspect, in a fifth possible implementation manner of the first aspect, the second conductor part includes a third conductor, where the third conductor is electrically connected to the fourth location on the conductor bezel.

With reference to the fifth possible implementation manner of the first aspect, in a sixth possible implementation manner of the first aspect, the second conductor part further includes a fourth conductor, where the fourth conductor is electrically connected to the third conductor.

With reference to the sixth possible implementation manner of the first aspect, in a seventh possible implementation manner of the first aspect, the fourth conductor and the third conductor are located on a same straight line, or an inclined angle formed between the fourth conductor and the third conductor is an acute angle, an obtuse angle, or a right angle.

With reference to the sixth possible implementation manner of the first aspect or the seventh possible implementation manner of the first aspect, in an eighth possible implementation manner of the first aspect, a location, electrically connected to the fourth conductor, on the third conductor is an end of the third conductor, or a location, electrically connected to the fourth conductor, on the third conductor is a location on the third conductor except an end of the third conductor.

With reference to the sixth possible implementation manner of the first aspect, the seventh possible implementation manner of the first aspect, or the eighth possible implementation manner of the first aspect, in a ninth possible implementation manner of the first aspect, a location, electrically connected to the third conductor, on the fourth conductor is an end of the fourth conductor, or a location, electrically connected to the third conductor, on the fourth conductor is a location on the fourth conductor except an end of the fourth conductor.

A second aspect of the present disclosure provides a communications terminal, including a mainboard, a conductor bezel, and a first conductor part, where a first location on the conductor bezel is electrically connected to a ground terminal on the mainboard, a second location on the conductor bezel is electrically connected to a ground terminal on the mainboard, and a radio frequency port on the mainboard of the communications terminal is electrically connected to a third location on the conductor bezel using the first conductor part; the third location on the conductor bezel is between the first location and the second location; the first conductor part includes a first conductor and a second conductor; the second conductor is electrically connected to the radio frequency port on the mainboard of the communications terminal, the first conductor is electrically connected to the third location on the conductor bezel, and the first conductor is further electrically connected to the second conductor; and a location, electrically connected to the second conductor, on the first conductor is a location on the first conductor except an end of the first conductor, and/or a location, electrically connected to the first conductor, on the second conductor is a location on the second conductor except an end of the second conductor.

With reference to the second aspect, in a first possible implementation manner of the second aspect, the antenna apparatus further includes a second conductor part, where the second conductor part is electrically connected to a fourth location on the conductor bezel, and the fourth location on the conductor bezel is between the first location and the second location.

With reference to the first possible implementation manner of the second aspect, in a second possible implementation manner of the second aspect, the second conductor part includes a third conductor, where the third conductor is electrically connected to the fourth location on the conductor bezel.

With reference to the second possible implementation manner of the second aspect, in a third possible implementation manner of the second aspect, the second conductor part further includes a fourth conductor, where the fourth conductor is electrically connected to the third conductor.

With reference to the third possible implementation manner of the second aspect, in a fourth possible implementation manner of the second aspect, the fourth conductor and the third conductor are located on a same straight line, or an inclined angle formed between the fourth conductor and the third conductor is an acute angle, an obtuse angle, or a right angle.

With reference to the third possible implementation manner of the second aspect or the fourth possible implementation manner of the second aspect, in a fifth possible implementation manner of the second aspect, a location, electrically connected to the fourth conductor, on the third conductor is an end of the third conductor, or a location, electrically connected to the fourth conductor, on the third conductor is a location on the third conductor except an end of the third conductor.

With reference to the third possible implementation manner of the second aspect, the fourth possible implementation manner of the second aspect, or the fifth possible implementation manner of the second aspect, in a sixth possible implementation manner of the second aspect, a location, electrically connected to the third conductor, on the fourth conductor is an end of the fourth conductor, or a location, electrically connected to the third conductor, on the fourth conductor is a location on the fourth conductor except an end of the fourth conductor.

It can be seen that in the technical solutions in some embodiments of the present disclosure, a conductor bezel is electrically connected to a ground terminal on a mainboard of a communications terminal, so that the conductor bezel and the mainboard of the communications terminal may form a closed loop. A first conductor part for implementing antenna excitation (the first conductor part is configured to implement antenna excitation, and therefore, may also be called a feeding part) is electrically connected between a radio frequency port on the mainboard of the communications terminal and a third location on the conductor bezel. As excited by an excitation signal (the excitation signal is a radio frequency signal) introduced by the first conductor part from the radio frequency port, an annular current may be generated on the closed loop formed by the conductor bezel, the mainboard of the communications terminal, and the like, so that at least one resonance frequency is generated. In addition, after a second conductor part is introduced, as excited by the excitation signal introduced by the first conductor part from the radio frequency port, a standing wave current may further be formed on the second conductor part, so that at least one more resonance frequency may be generated. Therefore, the first conductor part and the second conductor part may collaborate to generate multiple resonance frequencies, so as to implement multi-frequency resonance, so that multiple bands may be supported. Using one conductor bezel can implement multi-frequency resonance, and further, can support multiple bands, which is conducive to reducing a quantity of slits/slots of the conductor bezel, and further, conducive to reducing antenna assembly complexity. In addition, one antenna bezel can implement multi-frequency resonance, and further, can support multiple bands, which is conducive to reducing a quantity of assembled antennas, and further, conducive to reducing hardware costs.

BRIEF DESCRIPTION OF DRAWINGS

To describe the technical solutions in the embodiments of the present disclosure more clearly, the following briefly describes the accompanying drawings required for describing the embodiments. The accompanying drawings in the following description show merely some embodiments of the present disclosure, and persons of ordinary skill in the art may still derive other drawings from these accompanying drawings without creative efforts.

DESCRIPTION OF EMBODIMENTS

Embodiments of the present disclosure provide a communications terminal, to reduce antenna assembly complexity and manufacturing costs of the communications terminal.

To make the disclosure objectives, features, and advantages of the present disclosure clearer and more comprehensible, the following describes the technical solutions in the embodiments of the present disclosure with reference to the accompanying drawings in the embodiments of the present disclosure. The embodiments described are merely a part rather than all of the embodiments of the present disclosure.

All other embodiments obtained by persons of ordinary skill in the art based on the embodiments of the present disclosure without creative efforts shall fall within the protection scope of the present disclosure.

In the specification, claims, and accompanying drawings of the present disclosure, the terms "first", "second", "third", "fourth", and so on are intended to distinguish between different objects but do not indicate particular order. In addition, the terms "including", "including", or any other variant thereof, are intended to cover a non-exclusive inclusion. For example, a process, a method, a system, a product, or a device that includes a series of steps or units is not limited to the listed steps or units, but optionally further includes an unlisted step or unit, or optionally further includes another inherent step or unit of the process, the method, the product, or the device.

Figure 1A:
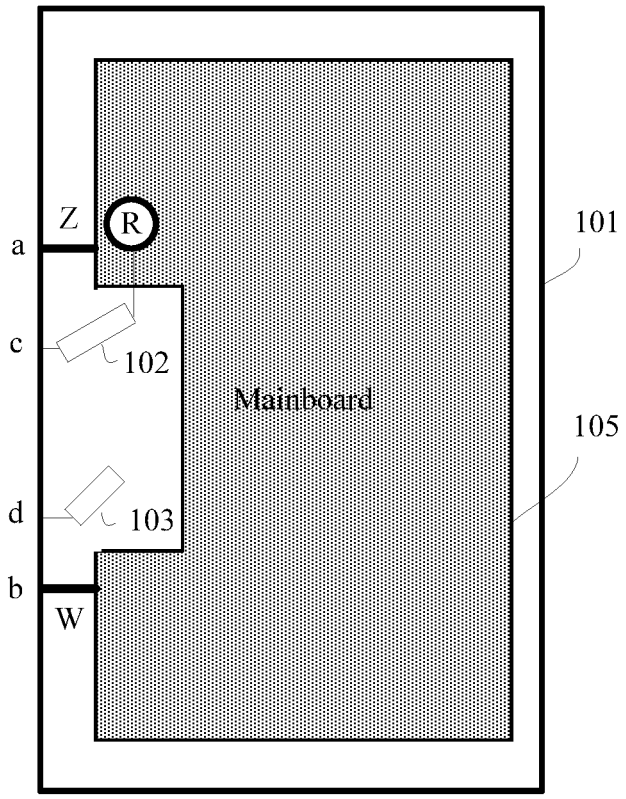
FIG. 1A is a schematic diagram of a communications terminal according to an embodiment of the present disclosure.
Figure 1B:
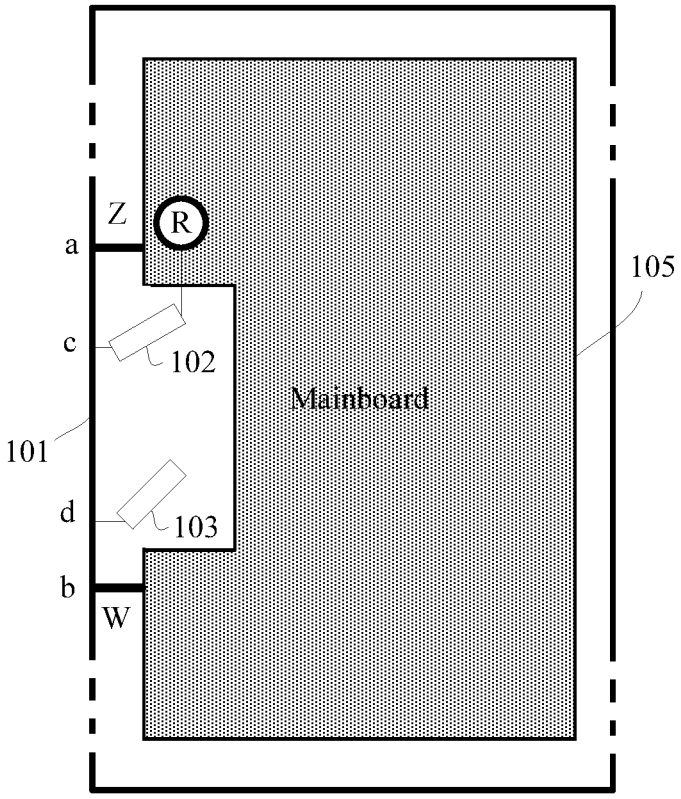
FIG. 1B is a schematic diagram of another communications terminal according to an embodiment of the present disclosure.

First, referring to FIG. 1A and FIG. 1B, FIG. 1A and FIG. 1B are schematic diagrams of two communications terminals according to an embodiment of the present disclosure.

As shown in FIG. 1A and FIG. 1B, the communications terminal provided in the embodiment of the present disclosure may include a mainboard 105, a conductor bezel 101, a first conductor part 102, and a second conductor part 103.

The conductor bezel 101 may be a metal bezel, and may also be made, by casting, of other materials that can be used as a conductor. The first conductor part 102 and the second conductor part 103 may be made, by casting, of metal or other materials that can be used as a conductor.

A first location on the conductor bezel 102 is electrically connected to a ground terminal on the mainboard 105. For example, the first location on the conductor bezel 102 may be electrically connected to the ground terminal on the mainboard 105 using a first grounding part Z.

A second location b on the conductor bezel 101 is electrically connected to a ground terminal on the mainboard 102. For example, the second location b on the conductor bezel 101 is electrically connected to the ground terminal on the mainboard 102 using a second grounding part W.

The second conductor part 103 is electrically connected to a fourth location d on the conductor bezel 101.

A radio frequency port R on the mainboard of the communications terminal is electrically connected to a third location c on the conductor bezel 101 using the first conductor part 102.

The fourth location d and the third location c on the conductor bezel 101 are between the first location a and the second location b.

It can be seen that in the solution in this embodiment, a conductor bezel is electrically connected to a ground terminal on a mainboard of a communications terminal, so that the conductor bezel and the mainboard of the communications terminal may form a closed loop (for example, the closed loop primarily includes a part between a first location and a second location of the conductor bezel, a first grounding part Z, a second grounding part W, a first ground terminal that is located on the mainboard and electrically connected to the first location on the conductor bezel, a second ground terminal that is located on the mainboard and electrically connected to the second location on the conductor bezel, a device that is located on the mainboard and electrically connected to the second ground terminal and the first ground terminal, and the like). A first conductor part for implementing antenna excitation (the first conductor part is configured to implement antenna excitation, and therefore, may also be called a feeding part) is electrically connected between a radio frequency port on the mainboard of the communications terminal and a third location on the conductor bezel. As excited by an excitation signal (the excitation signal is a radio frequency signal) introduced by the first conductor part from the radio frequency port, an annular current may be generated on the closed loop formed by the conductor bezel, the mainboard of the communications terminal, and the like, so that at least one resonance frequency is generated. In addition, after a second conductor part is introduced, as excited by the excitation signal introduced by the first conductor part from the radio frequency port, a standing wave current may further be formed on the second conductor part, so that at least one more resonance frequency may be generated. Therefore, the first conductor part and the second conductor part may be combined to generate at least two resonance frequencies, so as to implement multi-frequency resonance (for example, at least two-frequency resonance), so that multiple bands may be supported. Using one conductor bezel (also called an antenna bezel) can implement multi-frequency resonance, and further, can support multiple bands, which is conducive to reducing a quantity of slits/slots of the conductor bezel, and further, conducive to reducing antenna assembly complexity. In addition, one antenna bezel can implement multi-frequency resonance, and further, can support multiple bands, which is conducive to reducing a quantity of assembled antennas, and further, conducive to reducing hardware costs.

The conductor bezel 101 may be an annular conductor bezel (as shown in FIG. 1A) or a non-annular conductor bezel (as shown in FIG. 1B). As shown in FIG. 1B, the conductor bezel of the communications terminal is divided into multiple segments, and the conductor bezel 101 is one of the conductor bezel segments of the communications terminal.

A specific structure of the first conductor part 102 may be diversified, and a specific structure of the second conductor part 103 may also be diversified.

Figure 2A:
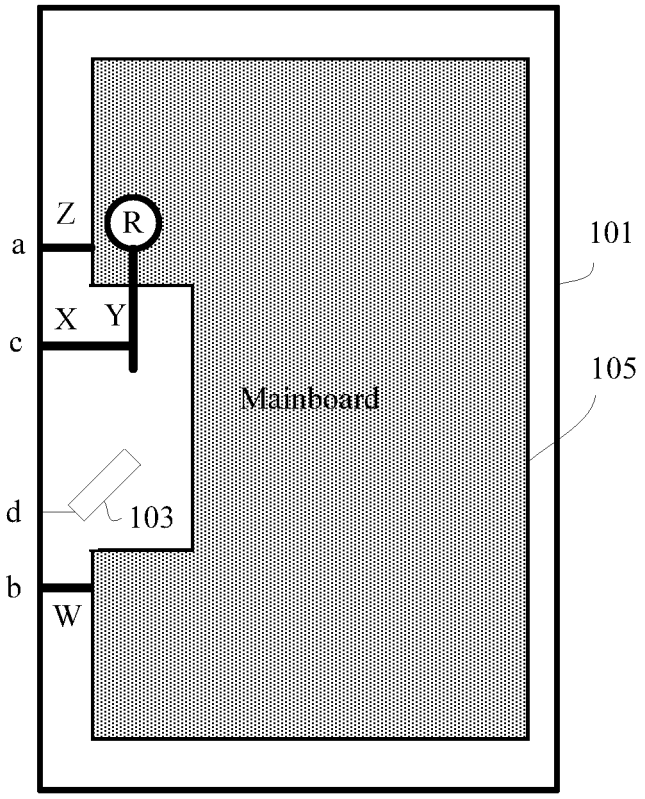
FIG. 2A to FIG. 2J are schematic diagrams of other communications terminals according to an embodiment of the present disclosure.

Optionally, for example, as shown in FIG. 2A, in some possible implementation manners of the present disclosure, the first conductor part 102 may include a first conductor X and a second conductor Y. The second conductor Y is connected to the radio frequency port R on the mainboard of the communications terminal, the first conductor X is electrically connected to the third location c on the conductor bezel 101, and the first conductor X is further electrically connected to the second conductor Y. A radio frequency signal output by the radio frequency port R on the mainboard of the communications terminal may be transmitted via the first conductor part 102 and the conductor bezel 101. Certainly, an external radio signal received by the conductor bezel 101 may also be input into the radio frequency port R on the mainboard of the communications terminal using the first conductor part 102. That is, the first conductor part 102 is configured to form a signal channel between the conductor bezel 101 and the radio frequency port R, and the first conductor part 102 may be called a feeding part.

Figure 2B:
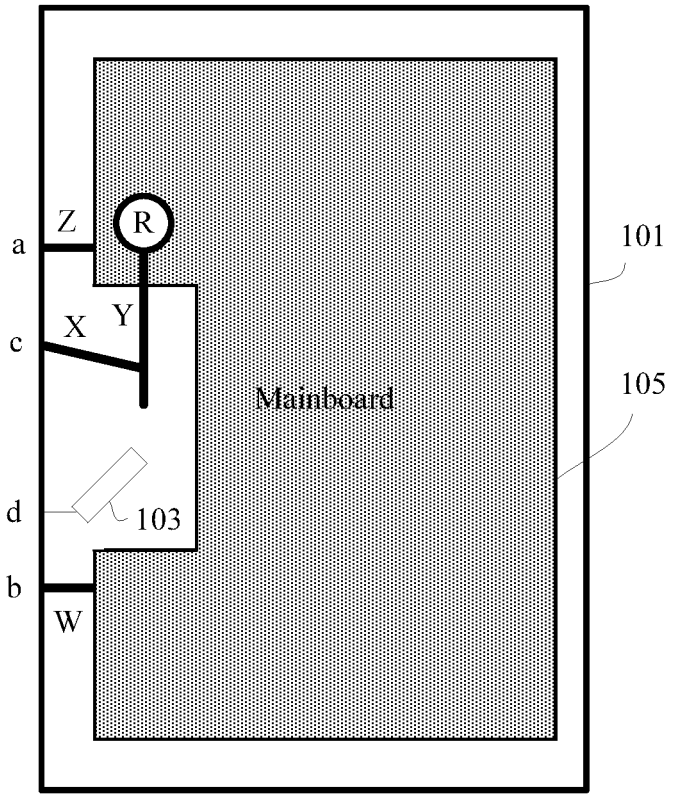
Figure 2C:
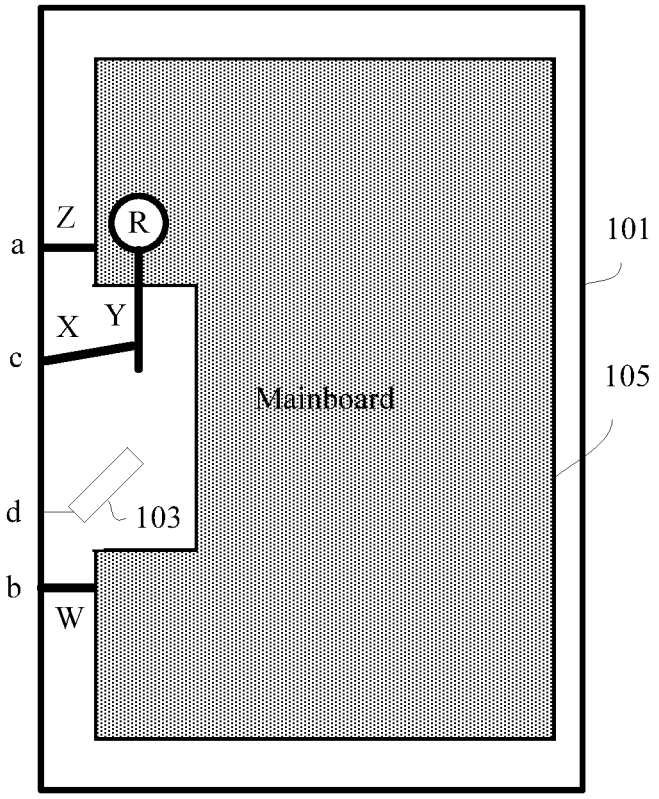

Optionally, in some possible implementation manners of the present disclosure, the first conductor X and the second conductor Y may be located on a same straight line; or an inclined angle formed between the first conductor X and the second conductor Y may be an acute angle (as shown in FIG. 2B), an obtuse angle (as shown in FIG. 2C), or a right angle (as shown in FIG. 2A). In an actual application, an angle relationship between the first conductor X and the second conductor Y may be adjusted according to a resonance frequency offset requirement.

Figure 2D:
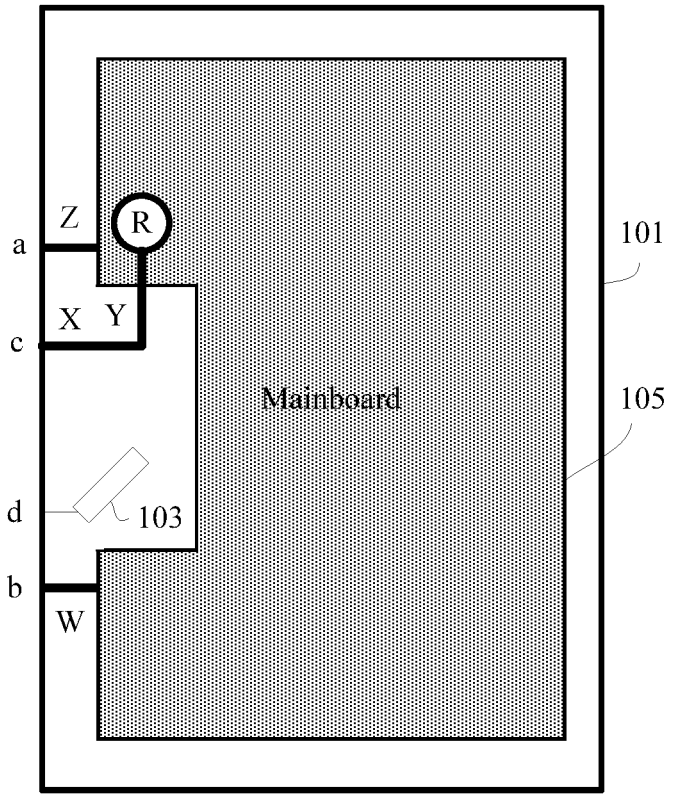

Optionally, in some possible implementation manners of the present disclosure, a location, electrically connected to the first conductor X, on the second conductor Y is an end (as shown in FIG. 2D) of the second conductor Y, or a location, electrically connected to the first conductor X, on the second conductor Y is a location (as shown in FIG. 2A, FIG. 2B, and FIG. 2C) on the second conductor Y except an end of the second conductor Y. In an actual application, a location at which the first conductor X is electrically connected to the second conductor Y may be adjusted according to a frequency offset requirement.

Figure 2E:
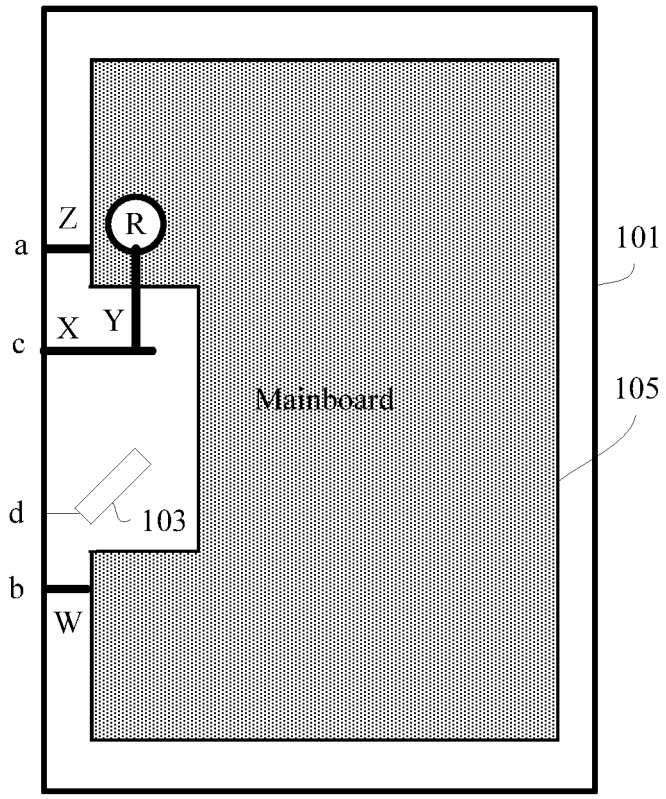

Optionally, in some possible implementation manners of the present disclosure, a location at which the first conductor X is electrically connected to the second conductor Y is an end (as shown in FIG. 2A, FIG. 2B, FIG. 2C, and FIG. 2D) of the first conductor X, or a location, electrically connected to the second conductor Y, on the first conductor X is a location (as shown in FIG. 2E) on the first conductor X except an end of the first conductor X. In an actual application, the location at which the first conductor X is electrically connected to the second conductor Y may be adjusted according to a resonance frequency offset requirement.

It should be noted that when the location, electrically connected to the second conductor Y, on the first conductor X is a location (as shown in FIG. 2E) on the first conductor X except an end of the first conductor X, or when the location, electrically connected to the first conductor X, on the second conductor Y is a location (as shown in FIG. 2A, FIG. 2B, and FIG. 2C) on the second conductor Y except an end of the second conductor Y, a standing wave current may be formed on the first conductor part, so that at least one more resonance frequency may be generated, which is conducive to further increasing a quantity of resonance frequencies.

Optionally, in some possible implementation manners of the present disclosure, the first conductor X and the second conductor Y may be integrated. Certainly, the first conductor X and the second conductor Y may also be electrically connected by means of welding or bonding or by other means. In FIG. 2A, FIG. 2B, FIG. 2C, FIG. 2D, and FIG. 2E, an example in which the first conductor X and the second conductor Y are of a straight line shape is used. Certainly, in another application scenario, the first conductor X and/or the second conductor Y may also be of a curve shape, a fold line shape, or another shape.

Figure 2F:
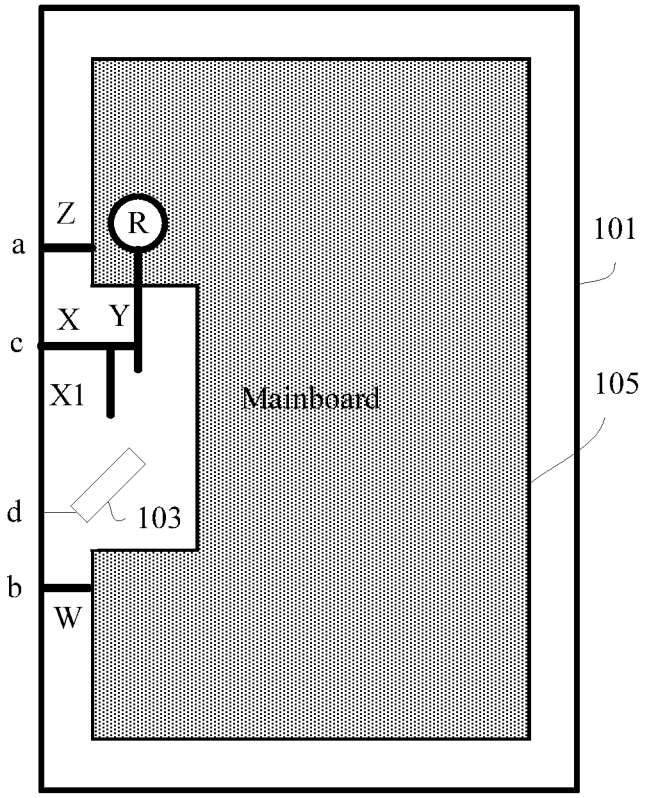

Optionally, in some possible implementation manners of the present disclosure, as shown in FIG. 2F, the first conductor part 102 may further include k1 fifth conductors X1 (k1 is a natural number, and in FIG. 2F, an example in which k1 is equal to 1 is used) disposed on the first conductor X. An inclined angle formed between the first conductor X and the fifth conductor X1 may be an acute angle, an obtuse angle, or a right angle, and in FIG. 2F, an example in which the inclined angle formed between the first conductor X and the fifth conductor X1 is a right angle is used. In an actual application, an angle relationship between the first conductor X and the fifth conductor X1 may be adjusted according to a resonance frequency offset requirement. In the accompanying drawing, an example in which the fifth conductor X1 is of a straight line shape is used. Certainly, in another scenario, the fifth conductor X1 may also be of a curve shape, a fold line shape, or another shape. After the fifth conductor is introduced, a standing wave current may be formed on the fifth conductor, so that at least one more resonance frequency may further be generated, which is conducive to further increasing the quantity of resonance frequencies.

Figure 2G:
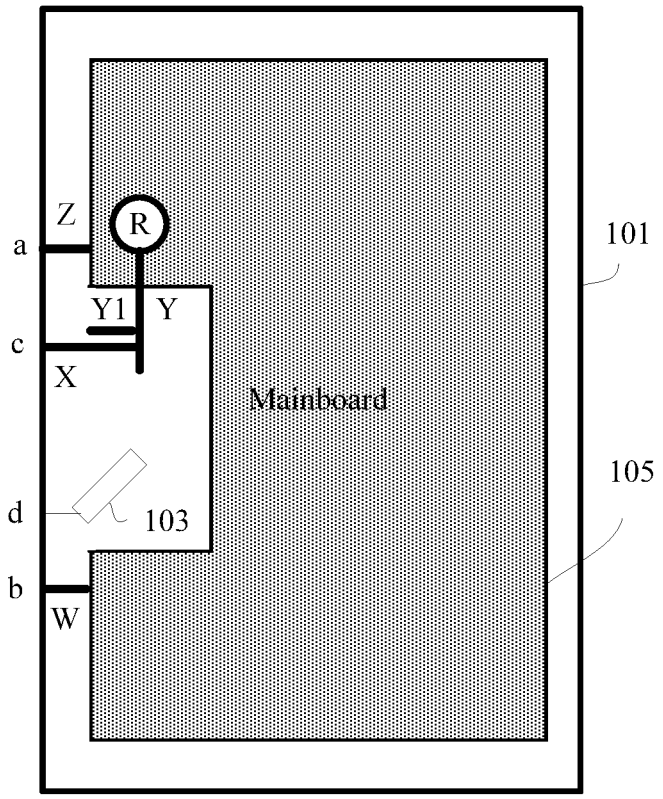

Optionally, in some possible implementation manners of the present disclosure, as shown in FIG. 2G, the first conductor part 102 may further include k2 sixth conductors Y1 (k2 is a natural number, and in FIG. 2F, an example in which k2 is equal to 1 is used) disposed on the second conductor X. An inclined angle formed between the first conductor X and the sixth conductor Y1 may be an acute angle, an obtuse angle, or a right angle, and in FIG. 2G, an example in which the inclined angle formed between the first conductor X and the sixth conductor Y1 is a right angle is used. In an actual application, an angle relationship between the first conductor X and the sixth conductor Y1 may be adjusted according to a resonance frequency offset requirement. In the accompanying drawing, an example in which the sixth conductor Y1 is of a straight line shape is used. Certainly, in another scenario, the sixth conductor Y1 may also be of a curve shape, a fold line shape, or another shape. After the sixth conductor is introduced, a standing wave current may be formed on the sixth conductor, so that at least one more resonance frequency may further be generated, which is conducive to further increasing the quantity of resonance frequencies.

In some actual applications, the location at which the first conductor X is electrically connected to the second conductor Y may be adjusted according to a frequency offset requirement. By adjusting a length of the first conductor X, adjusting a length of the second conductor Y, and/or adjusting the location at which the first conductor X is electrically connected to the second conductor Y, the first conductor part 102 may, for example, generate resonance frequencies within two bands (for example, within two bands 2.4 gigahertz (GHz)-2.5 GHz and 4.9 GHz-5.9 GHz, within two bands 880 megahertz (MHz)-960 MHz and 1710 MHz-1880 MHz, or within other two bands). That is, the resonance frequencies generated by the first conductor part 102 may be changed by adjusting at least one of the following objects: the length of the first conductor X, the length of the second conductor Y, the location at which the first conductor X is electrically connected to the second conductor Y, and the like.

Figure 2H:
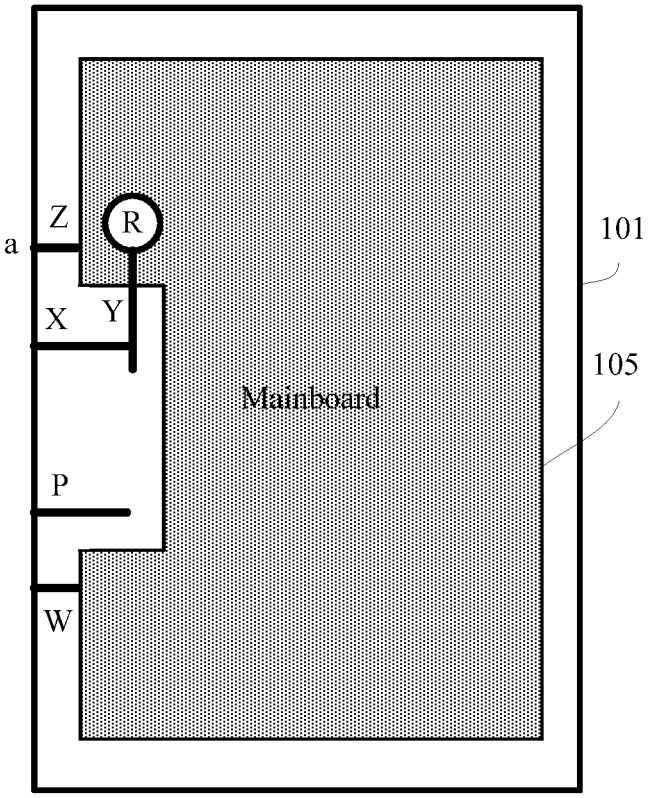

Optionally, in some possible implementation manners of the present disclosure, for example, as shown in FIG. 2H, the second conductor part 103 may include a third conductor P, where the third conductor P is electrically connected to the fourth location d on the conductor bezel 101.

Figure 2I:
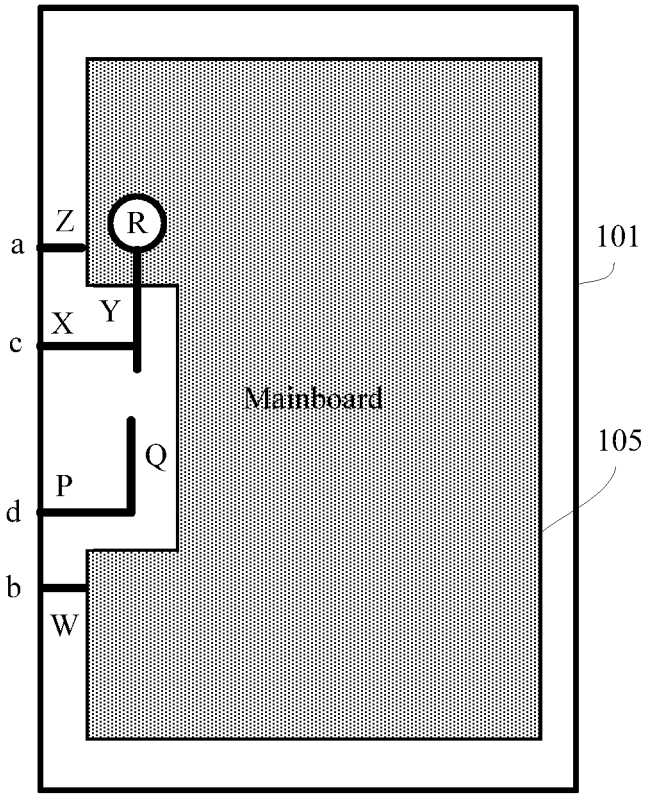

Optionally, in some possible implementation manners of the present disclosure, for example, as shown in FIG. 2I, the second conductor part 103 may further include a fourth conductor Q, where the fourth conductor Q is electrically connected to the third conductor P.

Optionally, in some possible implementation manners of the present disclosure, the fourth conductor Q and the third conductor P may be located on a same straight line; or an inclined angle formed between the fourth conductor Q and the third conductor P may be an acute angle, an obtuse angle, or a right angle, and in FIG. 2I, an example in which the inclined angle formed between the fourth conductor Q and the third conductor P is a right angle is used. In an actual application, an angle relationship between the fourth conductor Q and the third conductor P may be adjusted according to a resonance frequency offset requirement.

Optionally, in some possible implementation manners of the present disclosure, a location, electrically connected to the third conductor P, on the fourth conductor Q is an end (for example, as shown in FIG. 2I) of the fourth conductor Q, or a location, electrically connected to the third conductor P, on the fourth conductor Q may be a location on the fourth conductor Q except an end of the fourth conductor Q. In an actual application, a location at which the third conductor P is electrically connected to the fourth conductor Q may be adjusted according to a resonance frequency offset requirement.

Optionally, in some possible implementation manners of the present disclosure, a location, electrically connected to the fourth conductor Q, on the third conductor P is an end (for example, as shown in FIG. 2I) of the third conductor P, or a location, electrically connected to the fourth conductor Q, on the third conductor P is a location on the third conductor P except an end of the third conductor P. In an actual application, a location at which the third conductor P is electrically connected to the fourth conductor Q may be adjusted according to a resonance frequency offset requirement.

After the second conductor part 103 is added, it is conducive to generating more resonance frequencies (for example, generating more resonance frequencies between two frequencies 2.4 GHz and 5.9 GHz; or generating more resonance frequencies between two frequencies 880 MHz and 1880 MHz), and further conducive to extending operating bandwidth of an antenna (such as a WIFI antenna). For example, the resonance frequencies generated by the second conductor part may be changed by adjusting at least one of the following objects: a length of the third conductor P, a distance between the third conductor P and the second grounding part W, a length of the fourth conductor Q, the location at which the third conductor P is electrically connected to the fourth conductor Q, and the like.

Figure 2J:
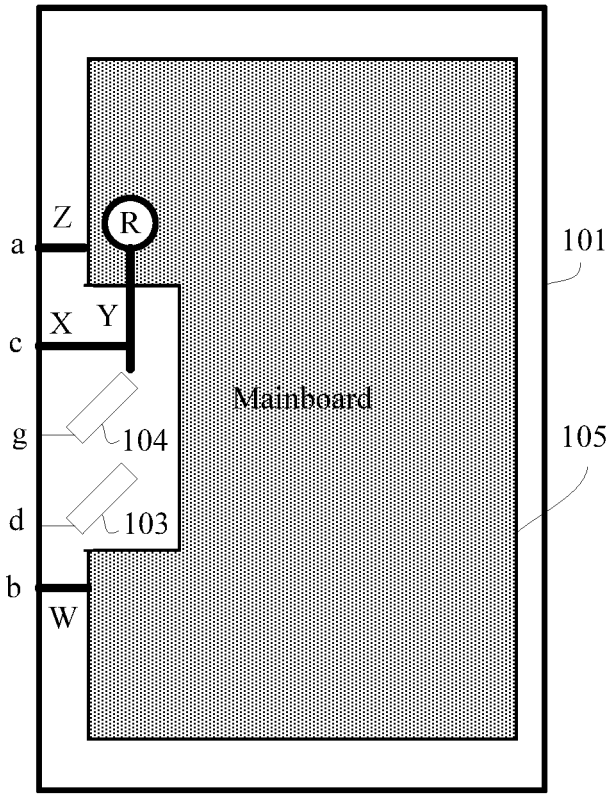

It may be understood that, in FIG. 2A to FIG. 2I, an example in which there is one second conductor part is used; certainly, in another application scenario, there may also be multiple second conductor parts. For example, referring to FIG. 2J, FIG. 2J shows, using an example, that an antenna apparatus may further include a third conductor part 104, and the third conductor part 104 is disposed at a fifth location g on the conductor bezel 101. A specific structure of the third conductor part 104 may be similar to that of the second conductor part 103, and is not described in detail herein using an example.

Figure 2K:
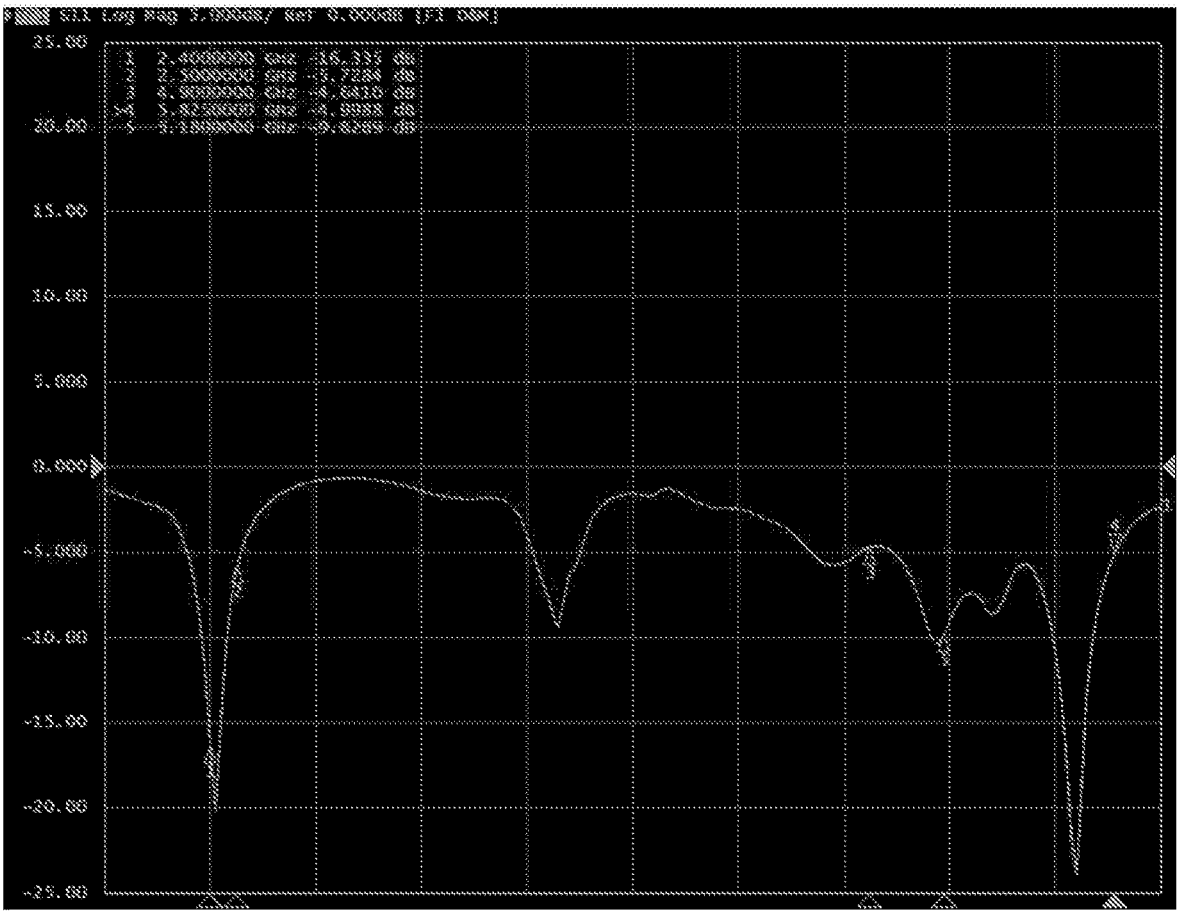
FIG. 2K is a schematic diagram of a reflection coefficient change according to an embodiment of the present disclosure.

FIG. 2K is a schematic diagram of a reflection coefficient change of an antenna of a communications terminal shown in FIG. 2I. A dimple in FIG. 2K is a resonance frequency.

Figure 2L:
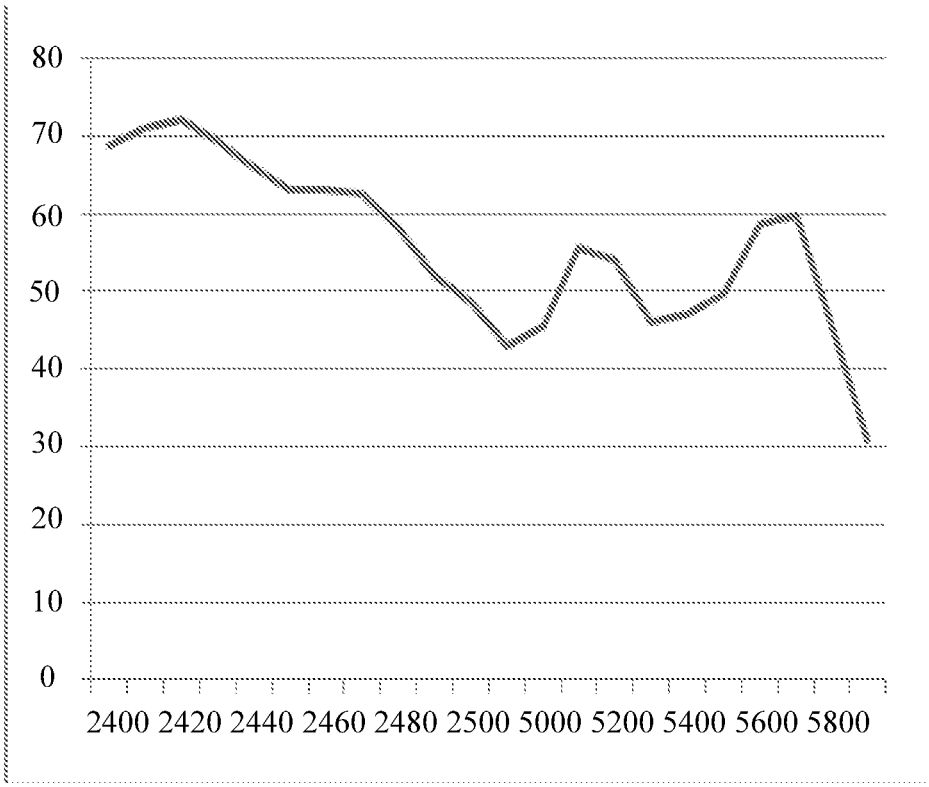
FIG. 2L is a schematic diagram of antenna apparatus efficiency according to an embodiment of the present disclosure.

FIG. 2L is a schematic diagram of antenna efficiency of a communications terminal with an architecture shown in FIG. 2I. In FIG. 2L, a horizontal axis represents a frequency (unit: MHz), and a vertical axis represents an efficiency percentage.

Figure 3A:
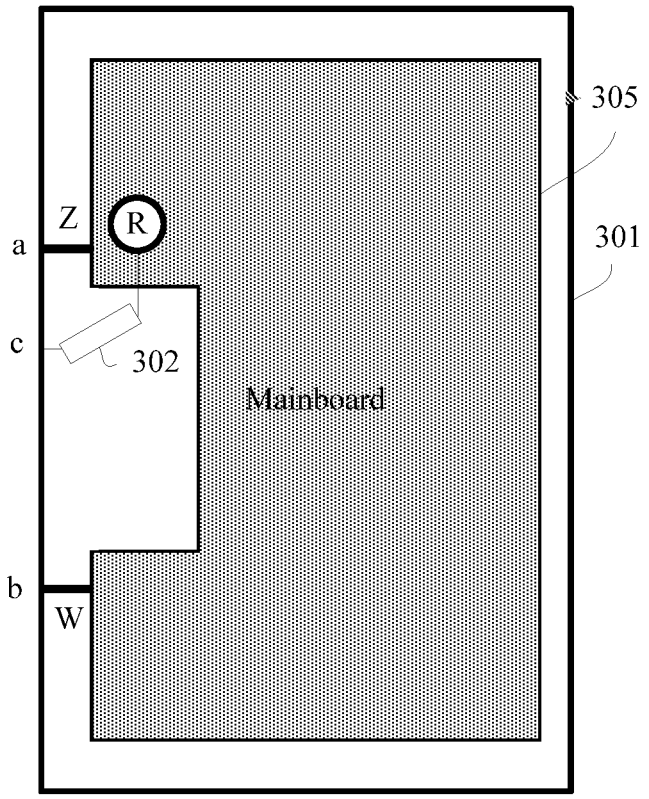
FIG. 3A to FIG. 3F are schematic diagrams of other communications terminals according to an embodiment of the present disclosure.

Referring to FIG. 3A, another embodiment of the present disclosure further provides another communications terminal, including a mainboard 305, a conductor bezel 301, and a first conductor part 302.

The conductor bezel 301 may be a metal bezel, and may also be made, by casting, of other materials that can be used as a conductor. The first conductor part 302 and a second conductor part 303 may be made, by casting, of metal or other materials that can be used as a conductor.

A first location a on the conductor bezel 302 is electrically connected to a ground terminal on the mainboard 305. For example, the first location a on the conductor bezel 302 may be electrically connected to the ground terminal on the mainboard 305 using a first grounding part Z.

A second location b on the conductor bezel 301 is electrically connected to a ground terminal on the mainboard 302. For example, the second location b on the conductor bezel 301 is electrically connected to the ground terminal on the mainboard 302 using a second grounding part W.

A third location c on the conductor bezel 301 is between the first location a and the second location b.

Figure 3B:
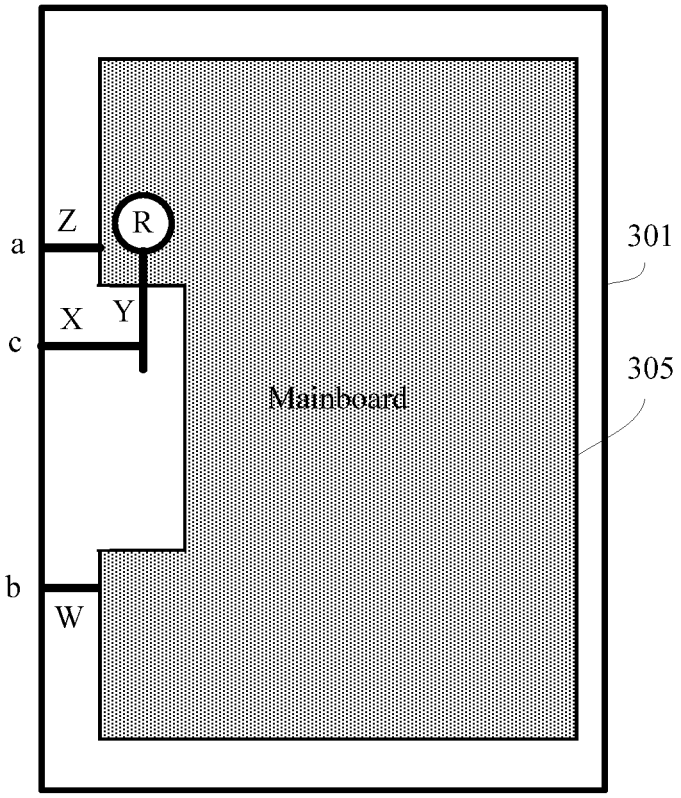

Referring to FIG. 3B, the first conductor part 302 includes a first conductor X and a second conductor Y.

The second conductor Y is electrically connected to a radio frequency port R on the mainboard of the communications terminal, the first conductor X is electrically connected to the third location c on the conductor bezel 301, and the first conductor X is further electrically connected to the second conductor Y.

A location, electrically connected to the first conductor X, on the second conductor Y is a location on the second conductor Y except an end of the second conductor Y, and/or a location, electrically connected to the second conductor Y, on the first conductor X is a location on the first conductor X except an end of the first conductor X. In an actual application, a location at which the first conductor X is electrically connected to the second conductor Y may be adjusted according to a resonance frequency offset requirement.

It can be seen that in the solution in this embodiment, a conductor bezel is electrically connected to a ground terminal on a mainboard of a communications terminal, so that the conductor bezel, the mainboard of the communications terminal, and the like may form a closed loop (for example, the closed loop primarily includes a part between a first location and a second location of the conductor bezel, a first grounding part Z, a second grounding part W, a first ground terminal that is located on the mainboard and electrically connected to the first location on the conductor bezel, a second ground terminal that is located on the mainboard and electrically connected to the second location on the conductor bezel, a device that is located on the mainboard and electrically connected to the second ground terminal and the first ground terminal, and the like). A first conductor part for implementing antenna excitation is electrically connected between a radio frequency port on the mainboard of the communications terminal and a third location on the conductor bezel. As excited by an excitation signal (the excitation signal is a radio frequency signal) introduced by the first conductor part from the radio frequency port, an annular current may be generated on the closed loop formed by the conductor bezel, the mainboard of the communications terminal, and the like, so that at least one resonance frequency is generated. In addition, because a location, electrically connected to a first conductor X, on a second conductor Y is a location on the second conductor Y except an end of the second conductor Y, and/or a location, electrically connected to the second conductor Y, on the first conductor X is a location on the first conductor X except an end of the first conductor X, as excited by the excitation signal introduced by the first conductor part from the radio frequency port, a standing wave current may be formed on the first conductor part, so that at least one more resonance frequency may be generated. In this way, a quantity of resonance frequencies increases. Therefore, the first conductor part and the closed loop may be combined to generate at least two resonance frequencies, so as to implement multi-frequency resonance (for example, at least two-frequency resonance), so that multiple bands may be supported. Using one conductor bezel (also called an antenna bezel) can generate multiple resonance frequencies and implement multi-frequency resonance, and further, can support multiple bands, which is conducive to reducing a quantity of slits/slots of the conductor bezel, and further, conducive to reducing antenna assembly complexity. In addition, one antenna bezel can implement multi-frequency resonance, and further, can support multiple bands, which is conducive to reducing a quantity of assembled antennas, and further, conducive to reducing hardware costs.

Figure 3C:
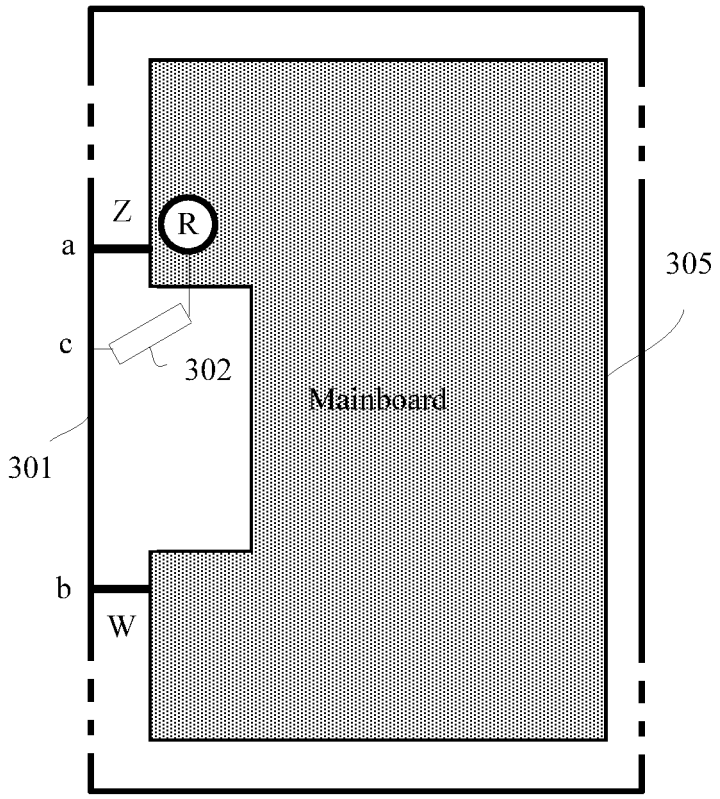

The conductor bezel 301 may be an annular conductor bezel (as shown in FIG. 3A and FIG. 3B) or a non-annular conductor bezel (as shown in FIG. 3C). As shown in FIG. 3C, the conductor bezel of the communications terminal is divided into multiple segments, and the conductor bezel 301 is one of the conductor bezel segments of the communications terminal.

Optionally, in some possible implementation manners of the present disclosure, an inclined angle formed between the first conductor X and the second conductor Y may be an acute angle, an obtuse angle, or a right angle. In an actual application, for example, an angle relationship between the first conductor X and the second conductor Y may be adjusted according to a resonance frequency offset requirement.

Figure 3D:
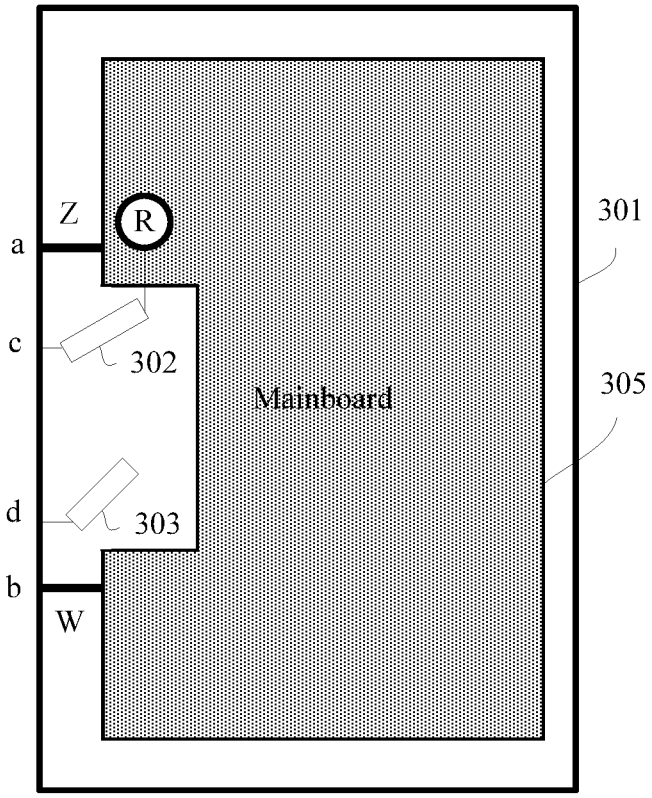

Optionally, in some possible implementation manners of the present disclosure, referring to FIG. 3D, the antenna apparatus further includes a second conductor part 303, where the second conductor part 303 is disposed at a fourth location d on the conductor bezel 301, and the fourth location d on the conductor bezel 301 is between the first location a and the second location b. After the second conductor part is introduced, a standing wave current may be formed on the second conductor part, so that at least one more resonance frequency may be generated.

Optionally, in some possible implementation manners of the present disclosure, the second conductor part 303 may have an exemplary structure of the second conductor part 303. For example, the second conductor part 303 includes a third conductor P, where the third conductor P is electrically connected to the fourth location d on the conductor bezel 301.

Optionally, in some possible implementation manners of the present disclosure, the second conductor part 303 further includes a fourth conductor Q, where the fourth conductor is electrically connected to the third conductor.

Optionally, in some possible implementation manners of the present disclosure, the fourth conductor and the third conductor are located on a same straight line, or an inclined angle formed between the fourth conductor and the third conductor is an acute angle, an obtuse angle, or a right angle.

Optionally, in some possible implementation manners of the present disclosure, a location, electrically connected to the fourth conductor, on the third conductor is an end of the third conductor, or a location, electrically connected to the fourth conductor, on the third conductor is a location on the third conductor except an end of the third conductor.

Optionally, in some possible implementation manners of the present disclosure, a location, electrically connected to the third conductor, on the fourth conductor is an end of the fourth conductor, or a location, electrically connected to the third conductor, on the fourth conductor is a location on the fourth conductor except an end of the fourth conductor.

In some actual applications, the location at which the first conductor X is electrically connected to the second conductor Y may be adjusted according to a frequency offset requirement. By adjusting a length of the first conductor X, adjusting a length of the second conductor Y, and/or adjusting the location at which the first conductor X is electrically connected to the second conductor Y, the first conductor part 102 may, for example, generate resonance frequencies within two bands (for example, within two bands 2.4 GHz-2.5 GHz and 4.9 GHz-5.9 GHz, within two bands 880 MHz-960 MHz and 1710 MHz-1880 MHz, or within other two bands). That is, the resonance frequencies generated by the first conductor part 302 may be changed by adjusting at least one of the following objects: the length of the first conductor X, the length of the second conductor Y, the location at which the first conductor X is electrically connected to the second conductor Y, and the like.

Figure 3E:
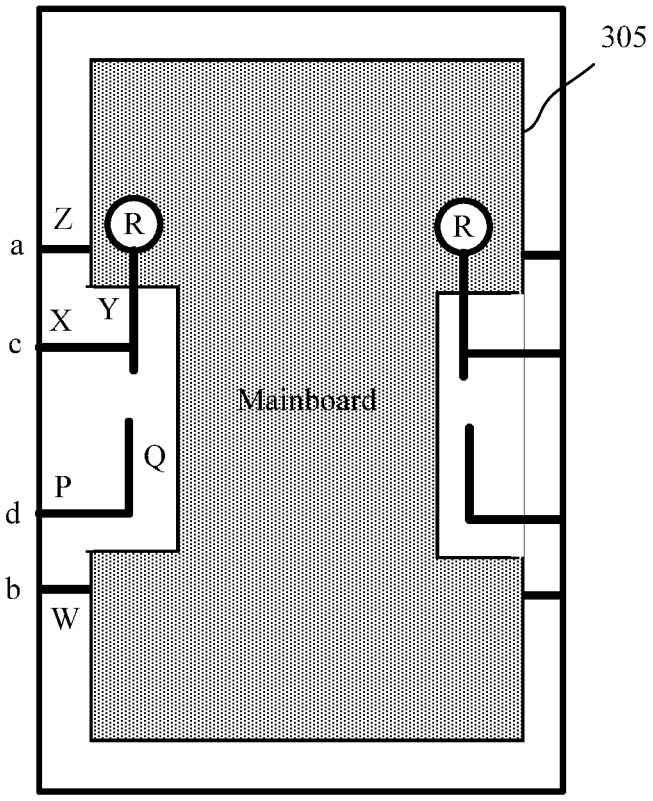
Figure 3F:
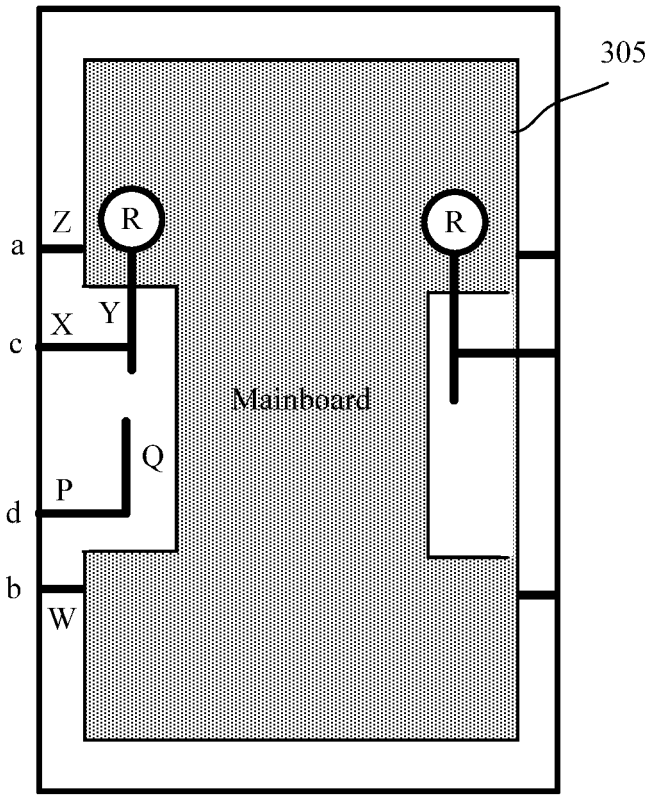

Referring to FIG. 3E and FIG. 3F, the communications terminal shown in FIG. 3E and FIG. 3F includes two antenna kits. Certainly, the communications terminal may also include more antenna kits. A part or all of the antennas may be the exemplary antennas described in the foregoing embodiment.

In the several embodiments provided in the present application, it should be understood that the disclosed apparatus may be implemented in other manners. For example, the described apparatus embodiment is merely exemplary. For example, the unit division is merely logical function division and may be other division in actual implementation. For example, a plurality of units or components may be combined or integrated into another system, or some features may be ignored or not performed. In addition, the displayed or discussed mutual couplings or direct couplings or communication connections may be implemented through some interfaces. The indirect couplings or communication connections between the apparatuses or units may be implemented in electronic or other forms.

The units described as separate parts may or may not be physically separate, and parts displayed as units may or may not be physical units, may be located in one position, or may be distributed on a plurality of network units. Some or all of the units may be selected according to actual needs to achieve the objectives of the solutions of the embodiments.

The foregoing embodiments are merely intended for describing the technical solutions of the present disclosure, but not for limiting the present disclosure. Although the present disclosure is described in detail with reference to the foregoing embodiments, persons of ordinary skill in the art should understand that they may still make modifications to the technical solutions described in the foregoing embodiments or make equivalent replacements to some technical features thereof, without departing from the scope of the technical solutions of the embodiments of the present disclosure.

The invention claimed is:

1. A communications terminal, comprising:

a mainboard;

a first ground terminal on the mainboard;

a second ground terminal on the mainboard;

a conductor bezel electrically coupled to the first ground terminal at a first location of the conductor bezel and electrically coupled to the second ground terminal at a second location of the conductor bezel;

an antenna feed;

a conductor port electrically coupled to the conductor bezel at a fourth location of the conductor bezel; and a radio frequency port on the mainboard, wherein the radio frequency port is electrically coupled to a third location on the conductor bezel using the antenna feed, and wherein the fourth location and the third location are between the first location and the second location and on a same edge of the conductor bezel as the first location and the second location.

2. The communications terminal according to claim 1, wherein the antenna feed comprises a first conductor and a second conductor, wherein the second conductor of the antenna feed is electrically connected to the radio frequency port on the mainboard of the communications terminal, wherein the first conductor of the antenna feed is electrically connected to the third location on the conductor bezel, wherein the first conductor of the antenna feed is further electrically connected to the second conductor of the antenna feed, and wherein the first conductor of the antenna feed is oriented in a different direction than the second conductor of the antenna feed.

3. The communications terminal according to claim 2, wherein an end of the first conductor is coupled to the second conductor.

4. The communications terminal according to claim 2, wherein the first conductor of the antenna feed is coupled to the second conductor of the antenna feed on a portion of the first conductor that is not an end of the first conductor.

5. The communications terminal according to claim 2, wherein an end of the second conductor of the antenna feed is coupled to the first conductor of the antenna feed.

6. The communications terminal according to claim 2, wherein the second conductor of the antenna feed is coupled to the first conductor of the antenna. feed at a portion of the second conductor that is not an end of the second conductor.

7. The communications terminal according to claim 2, wherein the conductor part comprises a third conductor, wherein the third conductor is electrically connected to the fourth location on the conductor bezel, and wherein the conductor part is decoupled from the mainboard.

8. The communications terminal according to claim 7, wherein the conductor part further comprises a fourth conductor electrically coupled to the third conductor.

9. The communications terminal according to claim 8, wherein a location on the third conductor at which the third conductor is coupled to the fourth conductor is an end of the third conductor.

10. The communications terminal according to claim 8, wherein the third conductor is coupled to the fourth conductor at a location on the third conductor other than an end of the third conductor.

11. The communications terminal according to claim 8, wherein a location of the fourth conductor at which the fourth conductor is coupled to the third conductor is an end of the fourth conductor.

12. The communications terminal according to claim 8, wherein the fourth conductor is coupled to the third conductor at a location on the fourth conductor other than an end of the fourth conductor.

13. A communications terminal, comprising:

a mainboard;

a first ground terminal on the mainboard;

a second ground terminal on the mainboard;

a conductor bezel electrically coupled to the first ground terminal at a first location on the conductor bezel and electrically coupled to the second ground terminal at a second location of the conductor bezel;

an antenna feed comprising a first conductor and a second conductor electrically coupled to the first conductor; and a radio frequency port on the mainboard, wherein the radio frequency port is electrically coupled to a third location on the conductor bezel using the antenna feed, wherein the third location is between the first location and the second location and is on a same edge of the conductor bezel as the first location and the second location, wherein the second conductor is electrically connected to the radio frequency port, and wherein the first conductor is electrically connected to the third location.

14. The communications terminal according to claim 13, wherein the first conductor is coupled to the second conductor at a location on the first conductor other than an end of the first conductor.

15. The communications terminal according to claim 13, wherein the second conductor is coupled to the first conductor at a location on the second conductor other than an end of the second conductor.

16. The communications terminal according to claim 13, wherein the communications terminal further comprises a conductor part electrically coupled to a fourth location on the conductor bezel, and wherein the fourth location is between the first location and the second location and on a same edge of the conductor bezel as the first location.

17. The communications terminal according to claim 16, wherein the conductor part comprises a third conductor electrically coupled to the fourth location on the conductor bezel.

18. The communications terminal according to claim 17, wherein the conductor part further comprises a fourth conductor electrically coupled to the third conductor.

19. The communications terminal according to claim 18, wherein a location of the third conductor at which the third conductor is coupled to the fourth conductor is an end of the third conductor.

20. The communications terminal according to claim 18, wherein the third conductor is coupled to the fourth conductor on a location on the third conductor other than an end of the third conductor.

21. The communications terminal according to claim 18, wherein the fourth conductor is coupled to the third conductor on a location on the fourth conductor other than an end of the fourth conductor.

* * * * *